US008592002B2

(12) United States Patent
Krumbacher et al.

(10) Patent No.: US 8,592,002 B2
(45) Date of Patent: Nov. 26, 2013

(54) METHOD FOR THE PRODUCTION OF SINGLE-AND/OR MULTIPLE-COATED SUBSTRATES

(75) Inventors: Erich Krumbacher, Ludwigshafen (DE); Norbert Willenbacher, Kirchheimbolanden (DE); Oliver Birkert, Fussgoennheim (DE); Martin Schachtl, Buch am Erlbach (DE); Christoph Hamers, Ludwigshafen (DE); Martin Tietz, Heidenheim (DE); Uwe Froehlich, Langenau (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1370 days.

(21) Appl. No.: 11/575,464

(22) PCT Filed: Sep. 15, 2005

(86) PCT No.: PCT/EP2005/009923

§ 371 (c)(1),
(2), (4) Date: Mar. 16, 2007

(87) PCT Pub. No.: WO2006/029860

PCT Pub. Date: Mar. 23, 2006

(65) Prior Publication Data

US 2008/0248321 A1 Oct. 9, 2008

(30) Foreign Application Priority Data

Sep. 17, 2004 (DE) ..... 10 2004 045 171

(51) Int. Cl.
*B05D 1/30* (2006.01)

(52) U.S. Cl.
USPC ..... 427/420

(58) Field of Classification Search
USPC ..... 427/420
See application file for complete search history.

(56) References Cited

U.S. PATENT DOCUMENTS

| | | | | |
|---|---|---|---|---|
| 3,632,374 | A | 1/1972 | Greiller | |
| 4,569,863 | A | 2/1986 | Koepke et al. | |
| 5,298,335 | A * | 3/1994 | Reed et al. | 428/511 |
| 5,447,753 | A * | 9/1995 | Noda et al. | 427/296 |
| 2003/0144408 | A1 | 7/2003 | Egraz et al. | |
| 2003/0177952 | A1 | 9/2003 | Cummings et al. | |
| 2004/0020615 | A1 | 2/2004 | Linhart et al. | |
| 2004/0121079 | A1 | 6/2004 | Urscheler et al. | |

FOREIGN PATENT DOCUMENTS

| | | |
|---|---|---|
| DE | 10 2004 002 207 | 8/2005 |
| EP | 0 517 223 | 12/1992 |
| EP | 1 249 533 | 10/2002 |
| EP | 1 411 168 | 4/2004 |
| JP | 5 34931 | 2/1993 |
| JP | 6 346400 | 12/1994 |
| JP | 7 119083 | 5/1995 |
| JP | 7 300796 | 11/1995 |
| WO | 02 066739 | 8/2002 |
| WO | WO 03030882 A1 * | 4/2003 |

* cited by examiner

*Primary Examiner* — Nathan Empie

(74) *Attorney, Agent, or Firm* — Oblon, Spivak, McClelland, Maier & Neustadt, L.L.P.

(57) ABSTRACT

A process for the production of singly and/or multiply coated paper and/or board, except for photographic papers and self-adhesive labeling papers, which are particularly suitable for printing, packaging and inscription, is described. The substrate, for example base paper or board, is coated once or several times with a free-falling liquid curtain, the coating liquid having in particular an extensional viscosity of from 1 to 1000 Pa·s at a Hencky strain of from 1 to 15.

14 Claims, 2 Drawing Sheets

METHOD FOR THE PRODUCTION OF SINGLE-AND/OR MULTIPLE-COATED SUBSTRATES

Figure 1:
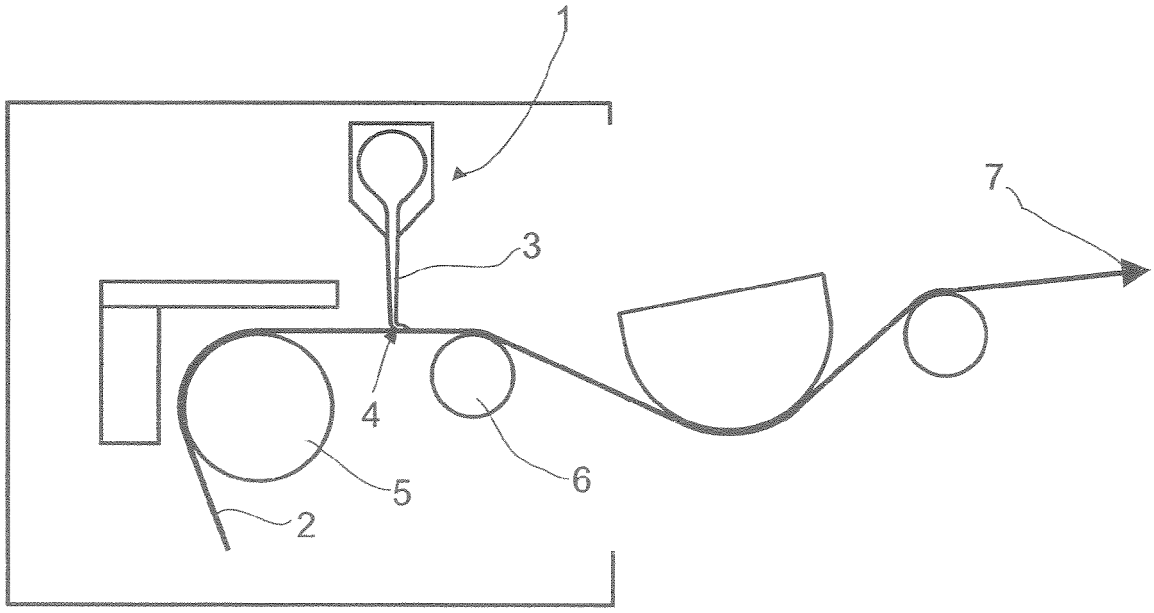

The present invention relates to a process for the production of singly and/or multiply coated substrates, such as paper and board, except for photographic papers and self-adhesive labeling papers.

PRIOR ART

The curtain coating method is a method known from the prior art and intended for coating in the photographic industry. The emulsions and liquids used in the photographic industry have a low solids content and only a low viscosity; moreover, the coating speed is very slow and is below 600 m/min. In the production of graphic arts papers, on the other hand, pigmented suspensions having a high solids content and high viscosities in comparison with the suspensions used in the photographic industry are used. Furthermore, graphic arts papers are generally produced by means of blade coating or a film press at speeds substantially above 1000 m/min. Both the blade coating method and the film press coating method have disadvantages which affect the quality of the coated paper. In the case of blade coating methods, for example, the aggregation of particles, induced by the high shear rates under the blade, can lead to stripes on the paper coat, which adversely affect the paper and cardboard quality. Furthermore, the coating slips used in the graphic arts industry impose such a strong stress on the blade used that it has to be replaced relatively frequently in order to ensure a constant coat quality on the paper or the box board.

Moreover, the coat distribution on the paper or the cardboard surface is influenced by the unevenness of the paper substrate. A nonuniform coat distribution on the paper surface can lead to visual nonuniformity of the print. This quality defect is also referred to as mottling.

In the abovementioned film press coating method, there is as a rule a limited operating window which is determined by the surface properties, the porosity of the substrate to be processed or the coating slip solids content. Furthermore, the abovementioned narrow operating window must be worked out afresh for each web speed or for each coat weight. In the case of nonoptimized film press coating slip formulations, a nonuniform film splitting pattern may therefore occur on the surface of the substrate to be coated, which in turn leads to poor printability thereof. Furthermore, small drops may form during film press coating and in turn be deposited on the substrate and result in lower quality of the coated substrate, whether paper, board or cardboard.

The maximum achievable coat weight in the film press coating method is likewise lower than that for the blade method. This limitation is particularly pronounced at high coating speeds on the substrate to be processed.

For the two coating methods described, the coat weight between elevations (peaks) and depressions (vales) of the substrate to be coated is nonuniformly distributed so that the printing ink acceptance is irregular, which may lead to the abovementioned mottling. Owing to the high coating speeds, both the film press method and the blade method are very widely used in the production of graphic arts papers.

JP 94/89437, JP 93/311931, JP 93/177816, JP 93/131718 and EP 0 517 223 B1 and EP-A 1 249 533 disclose the use of the curtain coating method for coating paper with one or more pigmented coating slips.

Thus, EP 0 517 223 B1 discloses a process for the production of coated printing paper. The coated paper produced is used in particular in printing, a free-falling coating curtain being produced from the coating liquid and the printing base paper being coated with the deaerated coating liquid so that the free-falling coating curtain of the coating liquid strikes the coating base paper. This runs continuously in a direction intersecting the free-falling coating curtain. The coating liquid comprises at least one pigment and at least one binder, a concentration of from 50 to 70% by weight and a viscosity of from 700 to 4000 mPa·s. The coating liquid is deaerated in an environment having a value of the vacuum of the saturation vapor pressure or lower and under the condition that shear is applied to the coating liquid. The deaeration ratio of the bubbles having a diameter of from 0.01 to 0.5 in in the coating liquid is 90% or more. The coating base paper has a primer coat which is applied by means of a coating method which is selected from the group which includes a coating method of the blade type or a coating method of the roll type.

EP 1 249 533 A1 discloses a process for the production of paper or cardboard. This process serves for the production of papers or cardboards provided with a plurality of coats, except for photographic papers and self-adhesive labeling paper. The multiply coated papers or cardboards can be used in particular for printing, packaging and inscription purposes, in which at least two liquids to be applied, selected from aqueous solutions or suspensions are brought together to give a combined, free-falling curtain, and a continuous web of base paper or base cardboard is coated with the combined coating fluid.

The use of the curtain coating method for converting paper and cardboard as described in EP 0 517 223 B1 and EP 1 249 533 A1, gives an improved coated surface structure in comparison with conventional coating methods. In particular, higher coating speeds can be achieved only with difficulty at low coal weights in the curtain coating method since the liquid curtain then becomes unstable. Furthermore, when the coating slip strikes the paper substrate, the coating slip is deflected during free fall and is accelerated to substrate speed. In this process, locally very high shear and strain rates occur in the fluid. The fluid falling as free curtain may be subjected to such great stress that breaking of the fluid film by cavitation bubbles may occur. The danger of breaking increases with increasing speed of the substrate web, which represents the upper limit at which the curtain coating method can be operated.

SUMMARY OF THE INVENTION

It is an object of the present invention to extend the ranges of use of the curtain coating method for pigmented coating slips.

This object is achieved, according to the invention, by a process for the production of singly and/or multiply coated paper and/or board, except for photographic papers and self-adhesive labeling papers, which are particularly suitable for printing, packaging and inscription, the substrate being singly or multiply coated with the coating liquid of a free-falling liquid curtain, and the coating liquid having an extensional viscosity, measured by the CaBER method, of from 1 to 1000 Pa·s at a Hencky strain of from 1 to 15. The coating slips preferably employed with the use of the process proposed according to the invention have the compositions shown below. All stated percentages are based on solids contents.

The coating slip used is one based on $CaCO_3$, for example a 77% strength slurry of calcium carbonate having a particle size of 90%<2 μm (Hydrocarb 90 ME, available from OMYA, Oftringen, Switzerland) and a 74.6% strength clay slurry of Amazon Premium having a particle size of 98%<2 μm (Amazon Plus, available from Kaolin International). Furthermore, the coating slips may comprise a binder A comprising styrene/butadiene latex (Styronal® D 536, available from BASF AG. Ludwigshafen), 50% in water. It is furthermore possible to admix various additives, for example an ASE thickener, available from BASF AG (additive C) and, alternatively or in combination, an additive A, polyacrylamide thickener (40 mol % of acrylic acid, 60 mol % of acrylamide, molecular weight 20 million) and an additive B, polyacrylamide thickener (40 mol % of acrylic acid, 60 mol % of acrylamide, molecular weight 44 million). Furthermore, the coating slips comprise a surfactant in the form of an aqueous solution of sodium dialkyisutfosuccinate (Lumiten® I-DS 3525), likewise available through BASF AG Finally, an optical brightener, for example in the form of Blancophor® P, available through Bayer AG, Leverkusen, can be admixed with the coating slips used in the process proposed according to the invention.

The extensional viscosity of the coating liquid, i.e. of the coating slip, is from 1 to 1000 Pa·s, measured by the CaBER method at a Hencky strain of from 1 to 15. The extensional viscosity is preferably from 5 to 500 Pa·s, measured by the CaBER method at a Hencky strain of from 1 to 12, and the extensional viscosity of the coating slip is particularly preferably from 10 to 100 Pa·s, measured by the CaBER method at a Hencky strain of from 1 to 8. The shear viscosity (100 rpm, Brookfield) of the coating liquid is from 0 to 5000, preferably from 0 to 2000, particularly preferably from 0 to 1000, mPa·s.

The coating liquid may have a solids content which is from 40 to 75%, preferably from 50 to 75%, particularly preferably from 60 to 65%.

The free-failing liquid curtain comprises at least one binder selected from the group consisting of styrene/butadiene latex binders, ethylene acrylic acid waxes, polyethylene, polyesters, styrene/acryl acrylate latex binders, styrene/butadiene/acrylonitrile latex binders, styrene/maleic anhydride binders, styrene/acrylate/maleic anhydride binders, polysaccharides, proteins, polyvinylpyrrolidones, polyvinyl alcohol, polyvinyl acetates, cellulose and cellulose derivatives. The free-failing liquid curtain additionally comprises organic and/or inorganic pigments selected from the group comprising kaolin, talc, calcium carbonate, precipitated calcium carbonate, titanium dioxide, satin white, synthetic polymer pigments, zinc oxides, barium sulfates, gypsum, silica and aluminum trihydrates.

In addition, the free-falling liquid curtain of coating slip comprises polyacrylamides which have a molecular weight Mw of from 1 to 50, preferably from 5 to 45, particularly preferably from 20 to 40, million.

The Brookfield viscosity of the free-falling liquid curtain is from 20 to 5000, preferably from 20 to 2000, particularly preferably from 20 to 1300, mPa·s (spindle No. 2).

The coat weight of the coating slip is from 0.1 to 50 g/m$^2$, based on the dry weight of the substrate.

The pH of the pigmented coating slip formulations described above was brought to 8.7 by adding 10% strength aqueous NaOH solution. The solids content of the coating slip formulations described above was established by dilution with water.

Associative thickeners may be used in the case of the additives added to coating slips. Associative thickeners are generally hydrophobically modified polymer thickeners having hydrophilic and hydrophobic structural units side by side. Important typical members of this class of thickeners are the polyurethane thickeners (=hydrophobically modified, ethoxylated urethanes HEUR or PU thickeners) and the HASE thickeners (=hydrophobically modified alkali-swellable emulsions). The associative thickeners are capable of being adsorbed on the surface of the binder particles via hydrophobic groups in the molecule and of forming with cellular, associative complexes in the aqueous phase. Consequently, the viscosity of the coating slips can be increased in a targeted manner at medium and high shear rate in binder-rich formulations. In the case of the cellulose ethers, too, hydrophobically modified types (HEER=hydrophobically modified cellulose ethers), generally starting from HEC or EHEC, are widely used. However, these tend to thicken conventionally and generally have only a weakly associative interaction with the binder particles. Polyurethane thickeners usually comprise polyethylene glycols, the isocyanates (for example hexamethylene diisocyanate) and hydrophobic polymers which have long-chain alcohols and possess a sort of three-block structure. The polyurethane block, which tends to be hydrophilic, is present in the middle, but the chain ends are each hydrophobically modified by the long-chain alcohol.

Suitable thickeners for coating materials or coating slips, in addition to free radical (co)polymers, are conventional organic and inorganic thickeners, such as hydroxyethylcellulose or bentonite.

Additives which may be used are moreover ionic or anionic polyacrylamides and polyvinylformamides.

The preparation of binder polymers is not limited to a certain process. Rather, all known processes for polymer preparation can be used. Preferably, the emulsion polymerization, the suspension polymerization, the microemulsion polymerization or the microsuspension polymerization processes are used, said processes making use of free radical polymerization.

Polymerization initiators which are suitable for initiating the polymerization are those which decompose either thermally or photochemically, form free radicals thereby and thus initiate the polymerization. Among the thermally activatable polymerization initiators, preferred ones are those which decompose at from 20 to 180° C., in particular from 50 to 90° C.

Particularly preferred polymerization initiators are peroxides, such as dibenzoyl peroxide, di-tert-butyl peroxide, peresters, percarbonates, perketals and hydroperoxides, but also inorganic peroxides, such as $H_2O_2$, salts of peroxosulfuric acid and peroxodisulfuric acid, azo compounds, boroalkyl compounds and homolytically decomposing hydrocarbons.

The initiators and/or photoinitiators, which, depending on the requirements which the material to be polymerized has to meet, are used in amounts of from 0.01 to 15% by weight, based on the polymerizable components, may be used individually or, for utilizing advantageous synergistic effects, in combination with one another.

As a rule, protective colloids are used for the preparation of the stable dispersions required for these polymerization processes.

Protective colloids used are water-soluble high molecular weight organic compounds having polar groups, such as polyvinylpyrrolidone, copolymers of vinyl propionate or acetate and vinylpyrrolidone, partly hydrolyzed copolymers of an acrylate and acrylonitrile, polyvinyl alcohols having different residual acetate contents, cellulose ethers, gelatin, block copolymers, modified starch, low molecular weight carboxyl- and/or sulfo-containing polymers or mixtures of these substances. Suitable natural protective colloids are any water-soluble proteins, partially degraded proteins, water-soluble cellulose ethers, natural starches, degraded starches and/or chemically modified starches. Water-soluble cellulose ethers are, for example, hydroxyethylcellulose and methyl-cellulose. Suitable natural starches are those which are obtainable by heating in an aqueous medium to temperatures above the gelatinization temperature of the starches. In addition, degraded starches which are obtainable by hydrolytic, oxidative or enzymatic degradation are suitable.

Particularly preferred protective colloids are polyvinyl alcohols having a residual acetate content of less than 35, in particular from 5 to 39, mol % and/or vinylpyrrolidone/vinyl propionate copolymers having a vinyl ester content of 35, in particular from 5 to 30, % by weight.

Nonionic or ionic emulsifiers, if appropriate also as mixture, may be used. Preferred emulsifiers are relatively long-chain alkanols or alkylphenols which are, if appropriate, ethoxylated or propoxylated and have different degrees of ethoxylation or propoxylation (for example, adducts with from 0 to 50 mol of alkylene oxide) or the neutralized, sulfated, sulfonated or phosphated derivatives thereof. Neutralized dialkylsulfosuccinic esters or alkyldiphenyl oxide disulfonates are also particularly suitable. Cationic emulsifiers are furthermore suitable.

Polymers are, for example, obtainable by polymerization of monomers from the group consisting of the alkyl esters of monoethylenically unsaturated $C_3$-$C_5$-carboxylic acids and monohydric $C_1$-$C_{22}$-alcohols, hydroxyalkyl esters of monoethylenically unsaturated $C_3$-$C_5$-carboxylic acids and dihydric $C_2$-$C_4$-alcohols, vinyl esters of saturated $C_1$-$C_{18}$-carboxylic acids, ethylene, propylene, isobutylene, $C_4$-$C_{24}$-α-olefins, butadiene, styrene, α-methylstyrene, acrylonitrile, methacrylonitrile, tetrafluoroethylene, vinylidene fluoride, fluoroethylene, chlorotrifluoroethylene, hexafluoropropene or mixtures thereof. These may be homo- or copolymers.

Preferably used monomers are methyl acrylate, ethyl acrylate, n-butyl acrylate, sec-butyl acrylate, tert-butyl acrylate, ethylhexyl acrylate, hydroxyethyl acrylate, hydroxypropyl acrylate, methyl methacrylate, n-butyl methacrylate, vinyl acetate, vinyl propionate, styrene, ethylene, propylene, butylene, isobutene, diisobutene and tetrafluoroethylene; particularly preferred monomers are methyl acrylate, ethyl acrylate, n-butyl acrylate, styrene, methyl methacrylate and vinyl acetate.

The anionic character of the polymers mentioned can be achieved, for example, by polymerizing the monomers on which the copolymers are based in the presence of anionic monomers, such as acrylic acid, methacrylic acid, styrenesulfonic acid, acryamido-2-methylpropanesulfonic acid, vinyl sulfonate and/or maleic acid, and, if appropriate, in the presence of emulsifiers and protective colloids.

The anionic character of the polymers mentioned can, however, be achieved by carrying out the copolymerization in the presence of anionic protective colloids and/or anionic emulsifiers.

The anionic character of the polymers mentioned can, however, also be achieved by emulsifying or dispersing the prepared polymers in the presence of anionic protective colloids and/or anionic emulsifiers.

The cationic character of the polymers mentioned can, for example, be achieved by copolymerizing the monomers on which the copolymers are based in the presence of cationic monomers, such as dimethylaminoethyl acrylate, dimethylaminoethyl methacrylate, diethylaminoethyl acrylate, diethylaminoethyl methacrylate dimethylaminopropyl acrylate, dimethylaminopropyl methacrylate, diethylaminopropyl acrylate, dimethylaminobutyl acrylate and diethylaminobutyl acrylate, and, if appropriate, in the presence of emulsifiers and protective colloids.

The cationic character of the polymers mentioned can, however, also be achieved by carrying out the copolymerization in the presence of cationic protective colloids and/or cationic emulsifiers.

The cationic character of the polymers mentioned can, however, also be achieved by emulsifying or dispersing the prepared polymers in the presence of cationic protective colloids and/or cationic emulsifiers.

The amphoteric character of the polymers mentioned can be achieved by carrying out the copolymerization in the presence of amphoteric protective colloids and/or amphoteric emulsifiers.

The amphoteric character of the polymers mentioned can also be achieved by emulsifying and dispersing the prepared polymers in the presence of amphoteric protective colloids and/or amphoteric emulsifiers.

Binder polymers comprise, for example, (a) from 0 to 100, preferably form 10 to 90, particularly preferably from 20 to 80, % by weight of at least one sparingly water-soluble or water-insoluble nonionic monomer, (b) from 0 to 60, preferably from 1 to 55, particularly preferably from 1 to 50, in particular from 1 to 5, % by weight of at least one carboxyl-comprising monomer or a salt thereof, (c) from 0 to 25, preferably from 0 to 3, % by weight of a monomer comprising sulfo and/or phosphonic acid groups, or a salt thereof, (d) from 0 to 55, preferably from 0 to 5, % by weight of at least one water-soluble nonionic emulsifier, (e) from 0 to 30, preferably from 0 to 10, % by weight of at least one polyethylenically unsaturated monomer in a form capable of being incorporated as polymerized units.

Polymers which comprise at least one anionic monomer (b) or (c) can be used without additional anionic emulsifiers or protective colloids. Polymers which comprise less than 0.5% of anionic monomers are generally used together with at least one anionic emulsifier or protective colloid.

Preferably used main monomers (a) are $C_1$-$C_{20}$-alkyl (meth)acrylates, vinyl esters of carboxylic acids of up to 20 carbon atoms, vinylaromatics of up to 20 carbon atoms, ethylenically unsaturated nitrites, vinyl halides, vinyl ethers, alcohols of 1 to 10 carbon atoms, aliphatic hydrocarbons having 2 to 8 carbon atoms and one or two double bonds or mixtures of these monomers.

Examples are alkyl(meth)acrylates having a $C_1$-$C_{10}$-alkyl radical, such as methyl methacrylate, methyl acrylate, n-butyl acrylate, ethyl acrylate and 2-ethylhexyl acrylate.

Mixtures of the alkyl(meth)acrylates are also particularly suitable.

Vinyl esters of carboxylic acids of 1 to 20 carbon atoms are, for example, vinyl laurate, vinyl stearate, vinyl propionate, vinyl versatate and vinyl acetate.

Suitable vinylaromatic compounds are vinyltoluene, α and β-methylstyrene, α-butylstyrene, 4-n-butylstyrene, 4-n-decylstyrene and preferably styrene. Examples of nitriles are acrylonitrile and methacrylonitrile.

The vinyl halides are unsaturated compounds substituted by chlorine, fluorine or bromine, preferably vinyl chloride and vinylidene chloride.

Examples of vinyl ethers are vinyl methyl ether or vinyl isobutyl ether. Vinyl ethers of alcohols of 1 to 4 carbon atoms are preferred.

Examples of hydrocarbons having 2 to 8 carbon atoms and one or 2 olefinic double bonds are ethylene, propylene, butadiene, isoprene and chloroprene.

Preferred main monomers are $C_1$-$C_{10}$-alkyl(meth)acrylates and mixtures of the alkyl(meth)acrylates with vinylaromatics, in particular styrene, or hydrocarbons having 2 double bonds, in particular butadienes, or mixtures of such hydrocarbons with vinylaromatics, in particular styrene.

In mixtures of aliphatic hydrocarbons (in particular butadiene) with vinylaromatics (in particular styrene), the ratio may be, for example, from 10:90 to 90:10, in particular from 20:80 to 80:20.

Particularly preferred main monomers are butadiene and the above mixtures of butadiene and styrene (polystyrene/butadiene for short) or $C_1$-$C_{10}$-alkyl methacrylates or mixtures thereof with styrene (polyacrylates for short).

Preferably used anionic secondary monomers (b) are acrylic acid, methacrylic acid, maleic acid or monoesters of maleic acid with $C_1$-$C_8$-alcohols.

Monomers of the group (c) are, for example, acrylamido-2-methylpropanesulfonic acid, vinylsulfonic acid, methallylsulfonic acid, vinylsulfonic acid and the alkali metal and ammonium salts of these monomers.

Suitable monomers (d) are, for example, acrylamide, methacrylamide, N-vinylformamide, N-vinylacetamide, N-vinylpyrrolidone, N-vinyloxazolidone, methylpolyglycol acrylates, methylpolyglycol methacrylates and methylpolyglycolacrylamides.

Suitable polyunsaturated monomers (e) are, for example, acrylates, methacrylates, allyl ethers or vinyl ethers of at least dihydric alcohols. The OH groups of the parent alcohols can be completely or partly etherified or esterified; however, the crosslinking agents comprise at least two ethylenically unsaturated groups. Examples are butadienodiol diacrylate, hexanediol diacrylate and trimethylolpropane triacrylate. Further unsaturated monomers (e) are, for example, allyl esters of unsaturated carboxylic acids, divinylbenzene, methylenebisacrylamide and divinylurea.

Such copolymers can be prepared by the known methods of solution, precipitation, suspension or emulsion polymerization of the monomers using free radical polymerization initiators. The polymers comprising particulate reactive crosslinking agents are preferably obtained by the method of emulsion polymerization in water. The polymers have, for example, molar masses of from 1000 to 2 million, preferably from 5000 to 500 000; in general, the molar masses of the polymers are from 10 000 to 150 000.

For limiting the molar masses of the polymers, it is possible to add conventional regulators during the polymerization. Examples of typical regulators are mercapto compounds, such as mercaptoethanol, thioglycolic acid, tert-dodecyl mercaptan, tert-butyl mercaptan and mercaptopropyltrimethoxysilane.

The emulsion polymerization is effected as a rule at from 30 to 130° C., preferably from 50 to 90° C. The polymerization medium may consist either only of water or of water-miscible liquids, such as methanol. Preferably, only water is used. The emulsion polymerization can be carried out both as a batch process and in the form of a feed process, including the step or gradient procedure. The feed process, in which a part of the polymerization batch is initially taken, heated to the polymerization temperature and partly polymerized and the remainder of the polymerization batch is then fed in continuously, stepwise or with superposition of a concentration gradient while maintaining the polymerization of the polymerization zone, usually via a plurality of spatially separate feeds, one or more of which comprise the monomers in pure emulsified form, is preferred. In the polymerization, initial introduction is also possible, for example for more readily establishing the particle size.

The manner in which the initiator is added to the polymerization vessel in the course of free radical aqueous emulsion polymerization is known, it can be either completely initially taken in the polymerization vessel or used continuously or stepwise at the rate of consumption in the course of the free radical aqueous emulsion polymerization. Specifically, this depends on the chemical nature of the initiator system and on the polymerization temperature.

Preferably, a part is initially taken and the remainder is fed to the polymerization zone at the rate of consumption.

For removing the residual monomers, initiator is usually added also after the end of the actual emulsion polymerization process, i.e. after a monomer conversion of at least 95%.

The individual components can be added to the reactor in the feed process from above, in the side or from below through the reactor bottom.

In the emulsion polymerization, aqueous dispersions of the polymer, as a rule having solids contents of from 15 to 75, preferably from 40 to 75, % by weight, are obtained.

The preparation of thickeners based on polyacrylamide is not limited to a certain process. Rather, a plurality of the known processes for polymer preparation can be used. The inverse emulsion polymerization or the inverse microemulsion polymerization processes which make use of free radical polymerization are preferably used.

For initiating the polymerization, polymerization initiators which decompose either thermally or photochemically, form free radicals and thus initiate the polymerization are suitable. Among the thermally activatable polymerization initiators, preferred ones are those which decompose at from 20 to 180° C., in particular from 20 to 90° C.

Possible polymerization initiators are oil-soluble peroxides, such as dibenzoyl peroxide, di-tert-butyl peroxide, peresters, percarbonates, perketals and hydroperoxides, but also inorganic peroxides, such as $H_2O_2$, salts of peroxosulfuric acid and peroxodisulfyric acid, azo compounds, boroalkyl compounds and homolytically decomposing hydrocarbons.

Particularly preferred polymerization initiators are redox initiators, such as persulfate/mercaptan systems, persulfate/sulfite systems, chlorine/bisulfite systems and hydrogen peroxide/iron systems.

The initiators and/or photoinitiators, which, depending on the requirements which the polymerizing material has to meet, are used in amounts of from 0.01 to 15% by weight, based on the polymerizable components, can be used individually or, for utilizing advantageous synergistic effects, in combination with one another.

For the preparation of the water-in-oil emulsion, a large number of organic liquids, comprising aromatic and aliphatic substances, such as benzene, xylene, toluene, mineral oils, kerosene and naphtha, are suitable. Particularly preferred oils for the preparation of polyacrylamide emulsions are straight-chain and branched liquid paraffins which, owing to their insolubility in water, nontoxicity and their high flash point, are suitable for industrial applications. They are also very economical.

The conventional amount of oil in the polyacrylamide emulsions used is in general from 20 to 50% by weight, based on water, from 10 to 40% by weight, based on oil, and from 20 to 50% by weight, based on polymer.

For the preparation of the stable emulsions required for these polymerization processes, as a rule nonionic and ionic emulsifiers are used.

For the preparation of water-in-oil emulsions, emulsifiers having a low HLB value are suitable, HLB being an abbreviation for hydrophilic-lipophilic balance. This class of substances is described extensively in the literature (for example in "The Atlas HLB Surfactant Selector").

Preferred emulsifiers are sorbitan esters and their ethoxylated derivatives. Sorbitan monooleates are particularly preferred. Further suitable emulsifiers for the preparation of water-in-oil macroemulsions are described in U.S. Pat. No. 3,284,393 by Vanderhoff et. al. Furthermore, all emulsifiers and macromolecules which permit the preparation of a water-in-oil emulsion are suitable.

The conventional amount of emulsifiers in the polyacrylamide emulsions used is in general from 0.1 to 30, preferably from 3 to 15, % by weight, based on oil.

Polyacrylamide thickener polymers comprise, for example, a) from 0 to 100, preferably from 10 to 90, particularly preferably from 10 to 80, % by weight of at least one water-soluble nonionic monomer,
b) from 0 to 99, preferably from 1 to 80, particularly preferably from 1 to 60, % by weight of at least one carboxyl-comprising monomer or a salt thereof,
c) from 0 to 99, preferably from 1 to 80, particularly preferably from 1 to 60, % by weight of at least one monomer comprising sulfo and/or phosphonic acid groups, or a salt thereof,
d) from 0 to 30, preferably from 0 to 1, % by weight of at least one polyethylenically unsaturated monomer in a form capable of being incorporated as polymerized units.

Preferably used water-soluble nonionic monomers (a) are, for example, $C_1$-$C_8$-(alk)acrylamides, acrylamide, N-vinylformamide, N-vinylacetamide, N-vinylpyrrolidones, N-vinyloxazolidone, methylpolyglycol acrylates, methylpolyglycol methacrylates and methylpolyglycolacrylamides.

Preferably used anionic secondary monomers (b) are acrylic acid, methacrylic acid, maleic acid or monoesters of maleic acid with $C_1$-$C_8$-alcohols.

Monomers of group (c) are, for example, acrylamido-2-methylpropanesulfonic acid, vinylsulfonic acid, methallylsulfonic acid and the alkali metal and ammonium salts of these monomers.

Suitable polyunsaturated monomers (d) are, for example, acrylates, methacrylates, allyl ethers or vinyl ethers of at least dihydric alcohols. The OH groups of the parent alcohols may be completely or partly etherified or esterified; however, the crosslinking agents comprise at least two ethylenically unsaturated groups. Examples are butanediol diacrylate, hexanediol diacrylate and trimethylolpropane triacrylate. Further unsaturated monomers (d) are, for example, allyl esters of unsaturated carboxylic acids, divinylbenzene, methylenebisacrylamide and divinylurea.

A further process for the preparation of anionic water-in-oil thickeners comprising $C_1$-$C_8$-(alk)acrylamides and acrylamide comprises the hydrolysis of nonionic $C_1$-$C_8$-(alk) acrylamides and acrylamide derivatives.

Suitable hydrolysis substances are, for example, alkali metal hydroxides or quaternary ammonium hydroxides. Particularly suitable hydrolysis agents are sodium, potassium and lithium hydroxide and tetramethylammonium hydroxide. Furthermore, all agents which give an alkaline pH in aqueous solution are suitable.

The preferred method for the hydrolysis of thickeners comprising $C_1$-$C_8$-(alk)acrylamides and acrylamides comprises the slow addition of the hydrolysis substances to the polymer emulsion in the form of an aqueous solution.

Hydrolysis agents comprise, for example from 0.1 to 50, preferably from 20 to 40, particularly preferably 30, % by weight of at least one aqueous alkali metal hydroxide solution.

The concentrations of the hydrolysis agents are, for example, from 0.1 to 30, preferably from 4 to 12, % by weight, based on % by weight of the polymeric thickener.

The exact concentration varies depending on the desired degree of hydrolysis of the nonionic thickener.

The hydrolysis reaction is carried out, for example, at from 10 to 70° C., preferably from 35 to 55° C. The duration of the hydrolysis is dependent on the reactants, the concentration thereof, reaction conditions and the desired degree of hydrolysis.

The $C_1$-$C_8$-(alk)acrylamides and acrylamide derivatives are then partly hydrolyzed. The degree of hydrolysis is, for example, from 3 to 80%, preferably from 5 to 60%, particularly preferably from 10 to 50%.

After the hydrolysis reaction of the $C_1$-$C_8$(alk)acrylamide and acrylamide derivative, the polymer remains in a water/oil emulsion, as described in U.S. Pat. No. 3,624,019 by Anderson et al.

Such copolymers can be prepared by the known methods for solution, precipitation, suspension or inverse emulsion polymerization of the monomers using free radical polymerization initiators. The polymers comprising $C_1$-$C_8$-(alk)acrylamide and acrylamides are preferably obtained by the method of inverse emulsion polymerization in water. The polymers have, for example, molar masses of from 1 to 55, preferably from 20 to 50, million.

In order to increase the molar masses of the polymers, low-temperature polymerization processes and crosslinking agents may be used.

The inverse microemulsions have a thermodynamically stable emulsion in comparison with macroemulsions. In particular, drop diameters of the aqueous phase in inverse microemulsions which are below 2 μm, preferably below 1 μm, are suitable. The inverse microemulsion polymers proposed according to the invention are to be obtained as follows:

For initiating the polymerization, polymerization initiators which decompose either thermally or photochemically, form free radicals and thus initiate the polymerization are suitable. Among the thermally activable polymerization initiators, preferred ones are those which decompose at from 20° C. to 180° C., in particular from 20° C. to 90° C.

Possible polymerization initiators are peroxides, such as dibenzoyl peroxide, di-tert-butyl peroxide, peresters, percarbonates, perketals and hydroxyperoxides, but also inorganic peroxides, such as $H_2O_2$, salts of peroxosulfuric acid and peroxodisulfuric acid, azo compounds, boroalkyl compounds and homolytically decomposing hydrocarbons.

Particularly preferred polymerization initiators are redox initiators, such as persulfate/mercaptan systems, persulfate/sulfite systems, chlorine/bisulfite systems and hydrogen peroxide/iron systems. The initiators and/or photoinitiators, which, depending on the requirements which the polymerization material has to meet, are used in amounts of from 0.01 to 15% by weight, based on the polymerizabie components, can be used individually or, for utilizing advantageous synergistic effects, in combination with one another.

For the preparation of the water-in-oil microemulsion, a large number of organic liquids, comprising aromatic and aliphatic substances, such as benzene, xylene, toluene, mineral oils, kerosene, naphtha and in particular straight-chain and branched liquid paraffins which, owing to their insolubility in water, their nontoxicity and their high flash point, are suitable for industrial applications are suitable. They are also very economical.

The conventional amount of oil in the polyacrylamide emulsions used is in general from 25 to 75% by weight, based on water.

For the preparation of the stable inverse microemulsions required for these polymerization processes, as a rule nonionic and ionic emulsifiers are used.

For the preparation of water-in-oil microemulsions, emulsifiers having a low HLB value are suitable, HLB being an abbreviation for hydrophilic-lipophilic balance. This class of substances has been described extensively in the literature, such as, for example, in "The Atlas HLB Surfactant Selector" Preferred HLB are from 8 to 11. Outside said range, usually no inverse microemulsions are obtained.

Preferred emulsifiers are sorbitan esters and their ethoxylated derivatives. Polyoxyethylene sorbitan trioleates, sorbitan trioleates, sodium di-2-ethylhexylsulfosuccinates, sodium isostearyl-2-lactates, oleamidopropyldimethylamines and mixtures are particularly preferred.

In addition to the replacement of the correct emulsifier, the concentration in which the emulsifiers are used must be optimized. Too low a concentration leads to inverse macroemulsions and concentrations which are too high lead to excessive costs.

The conventional amounts of emulsifiers in the polyacrylamide emulsions used are in general from 0.1 to 30, preferably from 3 to 15, % by weight, based on oil.

Polyacrylamide thickener polymers comprise, for example.

a) from 0 to 100, preferably from 10 to 90, particularly preferably from 0 to 80, % by weight of at least one water-soluble nonionic monomer,
b) from 0 to 99, preferably from 1 to 80, particularly preferably from 1 to 60, % by weight of at least one carboxyl-comprising monomer or a salt thereof,
c) from 0 to 99, preferably from 1 to 80, particularly preferably from 1 to 60, % by weight of at least one monomer comprising sulfo and/or phosphonic acid groups, or a salt thereof.
d) from 0 to 30, preferably from 0 to 1, % by weight of at least one polyethylenically unsaturated monomer in a form capable of being incorporated as polymerized units.

Preferably used, water-soluble nonionic monomers a) are, for example, $C_1$-$C_8$-(alk)acrylamides, acrylamide, N-vinylformamide, N-vinylacetamide, N-vinylpyrrolidone, N-vinyloxazolidone, methylpolyglycol acrylate, methylpolyglycol methacrylate and methylpolyglycolacrylamide, N,N'-dialkylacrylamide, for example dimethylacrylamide, and furthermore methyl acrylate, methyl methacrylate and acrylonitrile.

Preferably used anionic secondary monomers according to b) are acrylic acid, methacrylic acid, maleic acid or monoesters of maleic acid with $C_1$-$C_8$-alcohols.

Monomers of group c) are, for example, acrylamido-2-methylpropanesulfonic acid, vinylsulfonic acid, methallylsulfonic acid and the alkali metal and ammonium salts of these monomers.

Suitable polyunsaturated monomers according to d) are, for example, acrylates, methacrylates, allyl ethers or vinyl ethers of at least dihydric alcohols. The OH groups of the parent alcohols are completely or partly etherified or esterified; however, the crosslinking agents comprise at least two ethylenically unsaturated groups. Examples are butanediol diacrylate, hexanediol diacrylate and trimethylolpropane triacrylate. Further unsaturated monomers according to d) are, for example, allyl esters, unsaturated carboxylic acids, divinylbenzene, methylenebisacrylamide and divinylurea, N,N'-methylenebismethacrylamide and N-methylallylacrylamide.

A further process for the preparation of anionic water-in-oil microemulsion thickeners comprising $C_1$-$C_8$-(alk)acrylamide and acrylamide comprises the hydrolysis of nonionic $C_1$-$C_8$-(alk)acrylamides and acrylamide derivatives. Suitable hydrolysis substances are, for example, alkali metal hydroxide and quaternary ammonium hydroxides.

Particularly suitable hydrolysis agents are sodium, potassium and lithium hydroxide and tetramethylammonium hydroxide.

Furthermore, all agents which give an alkali pH in aqueous solution are suitable.

The preferred process for the hydrolysis of thickeners comprising $C_1$-$C_8$-(alk)acrylamide and acrylamide comprises the slow addition of the hydrolysis substances to the polymer emulsion in the form of an aqueous solution.

Hydrolysis reagents comprise, for example, from 0.1 to 50, preferably from 20 to 40, particularly preferably 30, % by weight of at least one aqueous alkali metal hydroxide solution.

The concentration of the hydrolysis agents is, for example, from 0.1 to 30, preferably from 4 to 12, % by weight, based on % by weight of the polymeric thickener. The exact concentration varies depending on the desired degree of hydrolysis of the nonionic thickener.

The hydrolysis reaction is carried out, for example, at from 10 to 70° C. preferably from 30 to 55° C. The duration of the hydrolysis is dependent on the reactants, the concentration thereof, reaction conditions and the desired degree of hydrolysis.

The $C_1$-$C_8$-(alk)acrylamide and acrylamide derivatives are then partly hydrolyzed. The degree of hydrolysis is, for example, from 3 to 80%, preferably from 5 to 60%, particularly preferably from 10 to 50%.

After the hydrolysis reaction of the $C_1$-$C_8$-(alk)acrylamide or acrylamide derivative, the polymer remains in a water-in-oil emulsion, as described, for example, in U.S. Pat. No. 3,624,019 by Anderson et al.

The polymers may have, for example, molar masses of from 1000 to 55 million, preferably from 20 to 50 million. In order to increase the molar masses of the polymers, low-temperature polymerization processes and crosslinking agents may be used.

The inverse microemulsion polymerization is effected as a rule at from 0 to 130° C., preferably from 0 to 60° C. The polymerization medium may comprise either only water or water-miscible liquids, for example methanol. Preferably, only water is used. The polymerization can be carried out both as a batch process and in the form of a free process, including a stepwise or gradient procedure. The feed process in which a part of the polymerization batch is initially taken, heated to the polymerization temperature and partly polymerized and then the remainder of the polymerization batch is fed to the polymerization zone continuously, stepwise or with superposition of a concentration gradient while maintaining the polymerization, usually via a plurality of spatially separate feeds one or more of which comprise the monomers in pure or emulsified form, is preferred.

The manner in which the initiator is added to the polymerization vessel in the course of the free radical aqueous emulsion polymerization is known. It may be either completely initially taken in the polymerization vessel or used continuously or stepwise at the rate of its consumption in the course of the free radical aqueous emulsion polymerization. Specifically, this depends on the chemical nature of the initiator system and on the polymerization temperature. Preferably, a part is initially taken and the remainder is fed to the polymerization zone at the rate of consumption.

For removing the residual monomers, initiator is usually added also after the end of the actual emulsion polymerization process, i.e. after a conversion of the monomers of at least 95%.

The individual components can be added to the reactor in the feed process from above, from the side or from below through the reactor bottom.

In the inverse emulsion polymerization and the inverse microemulsion polymerization, water-in-oil emulsions of the polymer, as a rule having solids contents of from 10 to 50, preferably from 20 to 40, % by weight, are obtained.

The thickeners can be used individually, but it is entirely possible to use thickener mixtures.

The associative thickeners or PAMs described above represent a selection of rheological additives which can be added to the coating slip composition proposed according to the invention.

With the coating slip proposed according to the invention, in particular the coat defects can be considerably minimized in the coating method on a substrate to be coated, for example paper or board, as is evident from the examples given below.

The extensional viscosity of the coating slip proposed according to the invention is determined in a CaBER experiment, a liquid thread or film being formed, the thickness of which subsequently decreases under the influence of the surface tension $\sigma$ as the dominant force. The decrease of the film thickness $D_{mid}(t)$ as a function of time is measured. The extensional viscosity $\eta_{E,app}$ is determined therefrom according to the following relationships $$\tau_E = \frac{2\sigma}{D_{mid}(t)}$$

The resulting extension rate $\epsilon$ (t) is obtained according to:

$$\varepsilon = -\frac{2}{D_{mid}}(t)\frac{\partial D_{mid}(t)}{\partial t}$$

The extensional viscosity $\eta_{E,app}=\tau_E/\epsilon$ is accordingly:

$$\eta_{E,app} = \frac{\tau_E}{\varepsilon} = -\frac{\sigma}{\frac{\partial D_{mid}(t)}{\partial t}}$$

VARIANTS/EXAMPLES

The viscosity of the coating slips according to the respective formulations mentioned below was determined by means of a Brookfield viscometer (RVT), available through Brookfield Engineering Laboratories, Inc., Stoughton, Mass. USA, at 25° C. For the measurement of the Brookfield viscosity, 600 ml of the dispersion were introduced into a 1 l beaker and the viscosity was measured using spindle No. 4 at a spindle speed of 100 rpm. The coating slips according to the following formulations were applied to the substrate (paper, cardboard) by means of curtain coating.

The determination of the properties of the coating slips to be obtained with the following formulations was carried out on the basis of the following test protocols:

Paper Gloss

Paper gloss is measured at an angle of incidence of 75° according to DIN 54 502

Prüfbau Offset

The test result is a measure of the ability of the substrate, whether paper or boxboard, to accept printing ink without the paper surface tending to pick. The number of experiments which can be carried out without the substrate tending to pick is identified with passes to fail. The Prüfbau offset comprises a Prüfbau printability tester MUII, a Prüfbau inking roll, 40 mm wide metal printing disks, an application pipette with which 0.01 ml can be metered, and an application pipette with which 0.001 ml can be metered, and furthermore long print sample supports and a stopwatch. The printing ink used was Novavit 4F 713 cyan from Kast & Ehinger. Samples measuring 240×46 mm are cut in the longitudinal direction from the substrates to be tested. They must have been stored separately from one another in a conditioning room for at least 15 hours before the test.

The test is effected by switching on the apparatus and then applying 0.3 ml of the printing ink to one of the inking rolls and then carrying out a run for 1 minute. Thereafter, a printing disk is inserted into the holder and is inked for 30 seconds. For each further printing disk, 0.03 ml of the printing ink is applied to this inking roll, after which in turn a run of 30 seconds is effected before this is inked. The inked inking roil can be used for 20 minutes at the most. The nip pressure is brought to 800 N (=200 N/cm), and the printing speed is 1 m/s. A paper strip is clamped on a print sample support and placed in the channel up to the stop before the right printing unit. The inked printing disk is mounted on the right printing unit core and the printing process is started by pressing the start button. If the hiding point was not reached with the amount of printing ink, the amount of printing ink and its supply must be increased to 0.4 and 0.04 ml or 0.5 and 0.05 ml. Only when the hiding point has been reached in the case of the paper strip is further testing continued.

The print sample support of the printed paper strip is brought to the starting position. It should be ensured that the strip is not touched with the fingers or other articles. After a fixed time span, which as a rule is 10 seconds, the printing process is started again without replacing the printing disks. This is repeated 5 times altogether. After each pass, the picking on the printed side of the paper strip is visually assessed. If no picking occurs after 6 passes, the determination is repeated at longer time intervals, for example 20 seconds or 30 seconds. The used printing disks and the inking rolls are cleaned with heavy naphtha before being used the next time and are dried with a cotton cloth.

A result can be expressed by counting the number of print passes before the occurrence of the initial picking and stating the ink application in ml and the time interval between the individual passes in seconds.

Roughness of the Paper

The roughness of the coated substrate, for example paper, was determined by means of a Parker Printsurf roughness tester. A sample of coated paper is clamped between a Cork-Melinex plate and a measuring head at a pressure of 1000 kPa. Compressed air is applied to the substrate at a pressure of 400 kPa, and the leakage of the air between the measuring head and the surface of the substrate is measured. A high measured result indicates high paper roughness of the coated substrate, in the present case paper.

Coat Uniformity

The substrate sample to be tested is immersed completely for the duration of 1 minute in a neocarmine solution MS "Fesago" (Merck Darmstadt). The substrate sample removed from the neocarmine solution is then washed under running tap water until there is no longer any coloration present. The sample is then placed between two filter papers and then dried in a dryer at 90° C. The appearance of the stained coat surface of the substrate sample is visually assessed.

Adjustment of Coat Weight

In each coating experiment, the coat weight is determined on the basis of the volume flow rate of the coating slip curtain through the curtain coating unit nozzle, the substrate speed, the density of the coating slip and the width of the coated paper.

Coating Slip Density

The density of the coating slip was determined by means of a densitometer.

Extensional Rheology Measurement

For determining the extensional rheology of the coating slips, a Haake CaBER 1 apparatus from ThermoElectron was used. The sample liquid (coating slip) is applied between two stamps. The diameter of the cylindrical stamps is 6 mm, the gap between the stamps is 3 mm and the height of the end gap is 11 mm. The sample liquid drops are extended from 3 mm to 11 mm in the course of 20 ms. A liquid thread forms thereby. The thread diameter ($D_{mid}$) is measured by means of a laser micrometer in the middle between the two stamps. The extensional viscosity is determined on the basis of the following formulae.

Assuming the surface tension ($\sigma$) as the driving force for the tearing of the liquid film in the CaBER experiment, there is an increasing shear stress according to the following relationships.

$$\tau_E = \frac{2\sigma}{D_{mid}(t)}$$

The resulting extension rate $\epsilon$ (t) is obtained according to:

$$\varepsilon = -\frac{2}{D_{mid}}(t)\frac{\partial D_{mid}(t)}{\partial t}$$

The extensional viscosity $\eta_{E,app}=\tau_E/\epsilon$ is accordingly calculated as follows:

$$\eta_{E,app} = \frac{\tau_E}{\varepsilon} = -\frac{\sigma}{\frac{\partial D_{mid}(t)}{\partial t}}$$

The Hencky strain $\epsilon$(t) is calculated as a measure of the extension of the liquid thread or film:

$$\varepsilon(t) = 2\ln\left(\frac{D_{initial}}{D_{mid}(t)}\right)$$

For the calculation of the rheological quantities on the basis of these equations, the change in the thread diameter $\delta D_{mid}(t)/\delta t$ is calculated numerically from the measured values $D_{mid}(t)$.

REFERENCES

1. Entov, V. M. and Hinch, E. J., J, Non-Newt. Fluid Mech., 72(1) (1997), 31
2. McKinley, G. H. and Tripathi, A., J. Rheol., 44(3) (2000), 653.
3. Willertbacher, N., Proc. of the Int. Congress on Rheology, Seoul, Korea (2004)

Table 1 shown below gives an overview of the formulations.

TABLE 1

Overview of the formulations

| | Formulation | | | | | |
|---|---|---|---|---|---|---|
| | 1 | 2 | 3 | 4 | 5 | 6 |
| $CaCO_3$ | 70 | 70 | 70 | 70 | 70 | 70 |
| Clay A | 30 | 30 | 30 | 30 | 30 | 30 |
| Latex A | 12 | 12 | 12 | 12 | 12 | 12 |
| Additive A | 0.25 | 0.16 | | | | |
| Additive B | | | 0.17 | 0.11 | | |
| Additive C | | | | | 0.27 | 0.19 |
| Surfactant | 0.3 | 0.3 | 0.3 | 0.3 | 0.3 | 0.3 |
| Optical brightener | 0.5 | 0.5 | 0.5 | 0.5 | 0.5 | 0.5 |
| Solids content | 66.8 | 66.7 | 66.2 | 66.5 | 66.2 | 66.2 |
| Brookfield viscosity at 100 rpm, spindle No. 4 | 1180 | 810 | 1130 | 850 | 1130 | 840 |
| pH | 8.7 | 8.7 | 8.7 | 8.7 | 8.7 | 8.7 |
| Extensional viscosity at Hencky strain of 1 in Pa · s | 1.94 | 1.27 | 1.85 | 1.42 | 0 | 0 |
| Extensional viscosity at Hencky strain of 6 in Pa · s | 0 | 9.9 | 14.4 | 13.0 | 0 | 0 |

The Brookfield viscosity of the formulations 1 to 6 was measured by means of a Brookfield RVT viscometer (obtainable from Brookfield Engineering Laboratories, Inc.) at room temperature of 25° C. For the measurement, 600 ml of the dispersion were introduced into a 1 l beaker and the viscosity was measured using spindle No. 4 at a spindle speed of 100 rpm.

Example 1

The formulation with the number 1 was applied to a woodfree 70 g/m$^2$ base paper by means of a simple curtain coating on the substrate in a coat weight 20 g/m at a paper web speed of 1200 m/min. Furthermore, at a constant volume flow rate, the paper web speed was increased in each case to 1400, 1600 and 1800 m/min so that the test points reproduced in table 2 below resulted.

TABLE 2

Overview of example 1

| Example | Formulation | Paper web speed (m/min) | Coat weight (g/m$^2$) |
|---|---|---|---|
| 1a | 1 | 1200 | 20 |
| 1b | 1 | 1400 | 17.1 |
| 1c | 1 | 1600 | 15 |
| 1d | 1 | 1800 | 13.3 |

The results obtained are summarized in table 3 below,

TABLE 3

Overview of results from examples 1a, 1b, 1c and 1d

| | Example | | | |
|---|---|---|---|---|
| | 1a | 1b | 1c | 1d |
| Smoothness | 1.73 | 1.57 | 1.66 | 1.83 |
| IGT (cm/s) | 125 | 137 | 139 | 138 |
| Prüfbau Offset 10 s (passes to fail) | 5 | 5 | 5 | 5 |
| Coat defects | none | none | many | many |

The results shown in table 3 show that very many coat defects occur at web speeds of 1400 m/min, with otherwise good paper properties.

Example 2

The formulation number 2 according to the list shown in table 1 "Overview of the formulations" was applied to a wood-free 70 g/m$^2$ base paper by means of simple curtain coating on the substrate with a coat weight of 20 g/m$^2$ at a paper web speed of 1200 m/min. Furthermore, at a constant volume flow rate, the paper web speed was increased in each case to 1400, 1600 and 1800 m/min so that four test points were established altogether, as compared with one another in table 4.

TABLE 4

Overview of example 2

| Example | Formulation | Paper web speed (m/min) | Coat weight (g/m$^2$) |
|---|---|---|---|
| 2a | 2 | 1200 | 20 |
| 2b | 2 | 1400 | 17.1 |
| 2c | 2 | 1600 | 15 |
| 2d | 2 | 1800 | 13.3 |

The results for the formulation 2 at paper web speeds of 1200 to 1800 m/min and decreasing coat weight of the coating slip to be applied are summarized in table 5.

TABLE 5

Overview of results for examples 2a, 2b, 2c and 2d

| | Example | | | |
|---|---|---|---|---|
| | 2a | 2b | 2c | 2d |
| Smoothness | 1.39 | 1.43 | 1.63 | 1.93 |
| IGT (cm/s) | 142 | 143 | 156 | 153 |
| Prüfbau Offset 10 s (passes to fail) | 5 | 5 | 5 | 5 |
| Coat defects | none | none | many | many |

The results listed in table 5 show that, at paper web speeds above 1400 m/min, very many coat defects occur with otherwise good paper properties. In comparison with formulation 1, a smaller amount of the additive A is added to formulation 2, which, however, as is evident from table 5, does not lead to a deterioration in the coat defects at identical speed of the paper web.

Example 3

The formulation of the coating slip according to number 3 (cf. overview according to table 1) was applied to a wood-free 70 g/m$^2$ base paper by means of simple curtain coating on the substrate to be processed with a coat weight of 20 g/m at a paper web speed of 1200 m/min. Furthermore, at constant volume flow rate of the coating slip according to formulation number 3, the paper web speed of 1200 m/min was increased in each case to 1400, 1600 and 1800 m/min so that, analogously to example 1 and example 2, four test points resulted, which are compared with one another in table 6 below.

TABLE 6

Overview of example 3

| Example | Formulation | Paper web speed (m/min) | Coat weight (g/m$^2$) |
|---|---|---|---|
| 3a | 3 | 1200 | 20 |
| 3b | 3 | 1400 | 17.1 |
| 3c | 3 | 1600 | 15 |
| 3d | 3 | 1800 | 13.3 |

The results obtained are shown in table 7 below.

TABLE 7

Overview of results for examples 3a, 3b, 3c and 3d

| | Example | | | |
|---|---|---|---|---|
| | 3a | 3b | 3c | 3d |
| Smoothness | 1.46 | 1.55 | 1.56 | 1.61 |
| IGT (cm/s) | 158 | 142 | 148 | 151 |
| Prüfbau Offset 10 s (passes to fail) | 5 | 5 | 5 | 5 |
| Coat defects | none | none | none | none |

The results listed in table 7 show that, even at web speeds of up to 1800 m/min, no coat defects occur, with otherwise good paper properties. According to table 1, the additive B is added to formulation 3, with the result that a significant increase in the coating speed can be achieved, no coat defects having been observable.

Example 4

The formulation number 4 according to table 1 was applied to a wood-free 70 g/m$^2$ base paper by means of simple curtain coating with a coat weight of 20 g/m at a paper web speed of 1200 m/min. Furthermore, analogously to the abovementioned examples 1, 2 and 3, at constant volume flow rate of the coating slip, the paper web speed of 1200 m/min was increased in each case to 1400, 1600 and 1800 m/min so that four test points resulted altogether, which are compared with one another below in table 8.

TABLE 8

Overview of example 4

| Example | Formulation | Paper web speed (m/min) | Coat weight (g/m$^2$) |
|---|---|---|---|
| 4a | 4 | 1200 | 20 |
| 4b | 4 | 1400 | 17.1 |

TABLE 8-continued

| Overview of example 4 | | | |
|---|---|---|---|
| Example | Formulation | Paper web speed (m/min) | Coat weight ($g/m^2$) |
| 4c | 4 | 1600 | 15 |
| 4d | 4 | 1800 | 13.3 |

The results obtained are compared with one another in table 9 below.

TABLE 9

| Overview of results for examples 4a, 4b, 4c, 4d | | | | |
|---|---|---|---|---|
| | Example | | | |
| | 4a | 4b | 4c | 4d |
| Smoothness | 1.36 | 1.43 | 1.65 | 1.63 |
| IGT (cm/s) | 145 | 155 | 159 | 156 |
| Prüfbau Offset 10 s (passes to fail) | 5 | 4 | 5 | 5 |
| Coat defects | none | none | many | many |

The results according to table 9 show that, at web speeds up to 1400 m/min, no significant coat defects are observable, with otherwise good paper properties. In formulation 4, on the other hand, the amount of additive B was reduced, which according to the results in table 9, causes a reduction in the maximum coating speed of the coating slip.

Example 5

The coating slip with the formulation according to number 5 of table 1 was applied to a wood-free 70 $g/m^2$ base paper by means of simple curtain coating on the substrate with a coat weight of 20 g/m at a paper web speed of 1200 m/min. Furthermore, at a constant volume flow rate, the paper web speed of 1200 m/min was increased in each case to 1400, 1600 and 1800 m/min so that four test points were established altogether, as compared with one another in table 10.

TABLE 10

| Overview of example 5 | | | |
|---|---|---|---|
| Example | Formulation | Paper web speed (m/min) | Coat weight ($g/m^2$) |
| 5a | 5 | 1200 | 20 |
| 5b | 5 | 1400 | 17.1 |
| 5c | 5 | 1600 | 15 |
| 5d | 5 | 1800 | 13.3 |

The results obtained are shown in the overview according to table 11.

TABLE 11

| Overview of results for examples 5a, 5b, 5c and 5d | | | | |
|---|---|---|---|---|
| | Example | | | |
| | 5a | 5b | 5c | 5d |
| Smoothness | 1.36 | 1.43 | 1.65 | 1.63 |
| IGT (cm/s) | 137 | 136 | 141 | 142 |

TABLE 11-continued

| Overview of results for examples 5a, 5b, 5c and 5d | | | | |
|---|---|---|---|---|
| | Example | | | |
| | 5a | 5b | 5c | 5d |
| Prüfbau Offset 10 s (passes to fail) | 5 | 5 | 5 | 5 |
| Coat defects | many | many | many | many |

The results according to table 11 show that, at web speeds of only 1200 m/min, very many coat defects occur, it otherwise being possible to assess the paper properties as good. Thus, additive C (HASE thickener (Sterocoll SL)) is not suitable for coating slips, which is due to the occurrence of a large number of coat defects even at low web speeds of the substrate to be processed.

Example 6

The formulation number 6 of the coating slip according to the overview in table 1 was applied to a wood-free 70 $g/m^2$ base paper by means of simple curtain coating on the substrate with a coat weight of 20 g/m at a paper web speed of 1200 m/min. Furthermore, analogously to the examples discussed above, at a constant volume flow rate of the coating slip to be applied, the paper web speed of 1200 m/min was increased in each case to 1400, 1600 and 1800 m/min. Four test points were established altogether and are compared with one another in the overview according to table 12.

TABLE 12

| Overview of example 6 | | | |
|---|---|---|---|
| Example | Formulation | Paper web speed (m/min) | Coat weight ($g/m^2$) |
| 6a | 6 | 1200 | 20 |
| 6b | 6 | 1400 | 17.1 |
| 6c | 6 | 1600 | 15 |
| 6d | 6 | 1800 | 13.3 |

The results according to example 6 with the use of formulation 6 are shown in the overview according to table 13.

TABLE 13

| Overview of results for examples 6a, 6b, 6c, 6d | | | | |
|---|---|---|---|---|
| | Example | | | |
| | 6a | 6b | 6c | 6d |
| Smoothness | 1.36 | 1.43 | 1.65 | 1.63 |
| IGT (cm/s) | 132 | 143 | 144 | 146 |
| Prüfbau Offset 10 s (passes to fail) | 5 | 5 | 5 | 5 |
| Coat defects | many | many | many | many |

The results according to the synopsis in table 13 show that, even at web speeds of 1200 m/min, very many coat defects have occurred, the paper properties otherwise having been found to be good. According to the results in the case of example 6 in table 13, the reduction of the additive C, i.e. of the ASE thickener, does not lead to a significant improvement of the coat defects. Thus, ASE-based thickener systems (additive C) are not suitable for curtain coating since, even at moderate speeds, a large number of coat defects occurred on the material to be processed.

As is evident from examples 1 to 6, the best results are obtained with the use of formulation 3. It was possible to achieve a significant increase in the coating speed, coating defects being absent (cf. results in table 7). On the other hand, a reduction of the additive B according to table 1, formulation 4, from 0.17 to 0.11 reduces the maximum coating speed up to which no coat defects occur. Although no coat defects occur with the use of formulation 4 at web speeds of 1200 and 1400 m/min, it is not possible to achieve a large increase in coating speed compared with formulation 3 in the case of a reduction of the additive B according to formulation 4.

Figure 2:
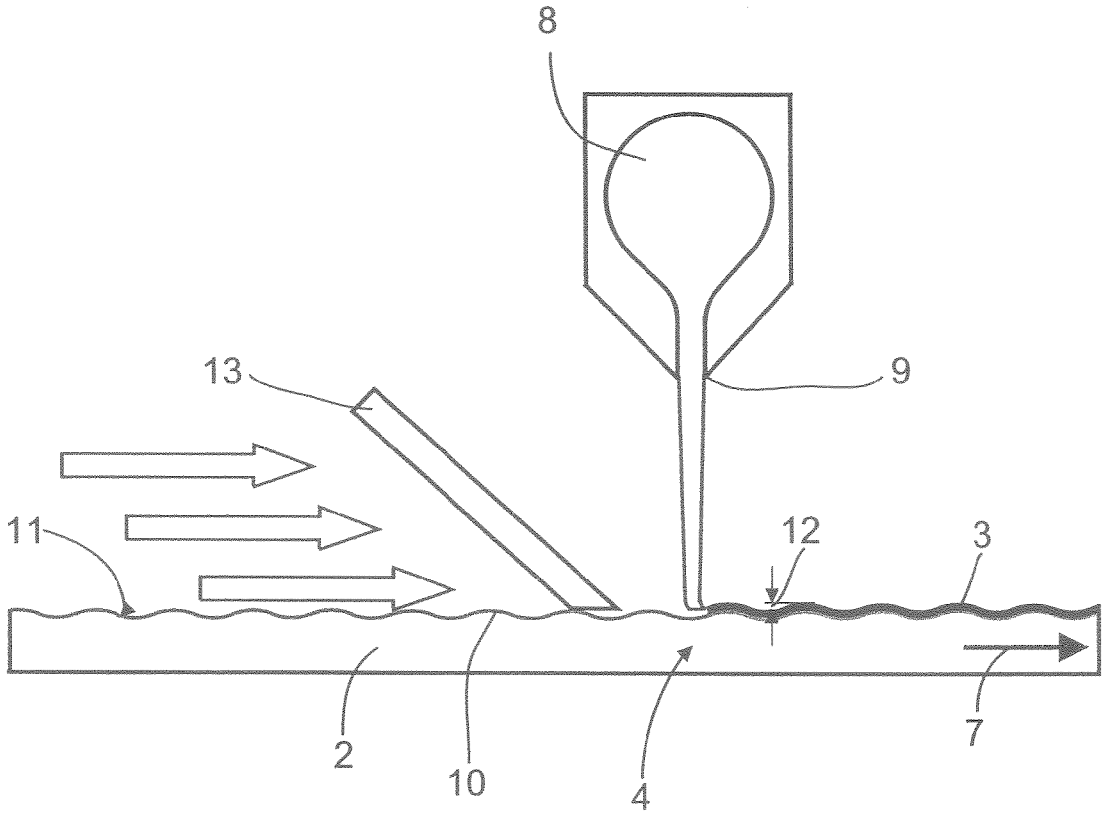

FIGS. 1 and 2 show a variant of an apparatus for the application of coating materials to a web-like substrate by the curtain coating method.

The diagram according to FIG. 1 shows a coating apparatus 1 by means of which the top of a web-like substrate 2 is coated. A film 3 emerging from an orifice of the coating apparatus 1 lands on the top surface of the web-like substrate 2 at an application point 4. The web-like substrate 2 is transported in the conveying direction 7 over a first deflection roll 5 and a second roll 6. In the region between the first deflection roll 5 and the second roll 6 is the application point 4 of the film 3 onto the top surface of the web-like substrate 2.

FIG. 2 shows the coating apparatus 1 according to the diagram in FIG. 1 on a larger scale.

The coating apparatus 1 comprises a nozzle body 8, on the underside of which is an outlet orifice 9. The coating slip stored in the nozzle body 8, having the composition discussed in examples 1 to 6, emerges in the form of a film 3 from the outlet orifice 9, the film 3 tapering continuously in the direction of the application point 4 and meeting the surface 10 of the web-like substrate 2 at the application point 4. Before the film 3 emerges from the outlet orifice 9, the film 3 is accelerated and a curtain extending over the width of the web-like substrate 2 forms at the underside of the outlet orifice 9, perpendicularly to the plane of the drawing. After the film 3 has emerged from the outlet orifice 9, it contracts and is deflected at the point of contact 4. The surface 10 of the web-like substrate 2 has a roughness 11; depending on the roughness 11 of the surface 10 of the web-like substrate, a film thickness 12 of the coating slip forms on the surface 10 of the web-like substrate 2. The web-like substrate 2 may be paper, cardboard or plastics films or the like. An air doctor blade 13 serves for holding back the air layer swept away from the substrate surface.

In the preparation of the coating slip, an aqueous pigment dispersion is first prepared. For this purpose, pigments are mixed with supplied water until the desired solids content and the desired viscosity have been reached. The viscosity of the slurry is preferably set very low for the degassing. It is less than 500, preferably less than 200, mPa·s (Brookfield, 100 rpm, 20° C.). Pigments which may be used are, for example, calcium carbonate, kaolin, titanium dioxide or talc. The binder can be added to the pigment dispersion in the container if it does not adversely affect the subsequent degassing. Alternatively, the binder may also be admixed only after the degassing. The degassing is effected inside a degassing apparatus in which the dispersion supplied is sprayed at reduced pressure. The gases emerging from the dispersion, in particular air, are discharged from the container. To enable the degassable components to emerge from the dispersion, i.e. the coating slip, the dispersion is distributed over a large surface at very low absolute pressure. The surface of the coating slip (dispersion) is preferably increased by spraying by means of nozzles; alternatively, an increase in the surface by the use of centrifugal plates would also be conceivable.

The dispersion provided with pigments can then be mixed with the thickener and the additives in the absence of air. The degassing apparatus may comprise for example, two degassing stages which are connected in series and in which the coating slip is subjected to degassing continuously in succession before the thickener and the additives are admixed in the absence of air. Depending on the characteristics of the coating slip, it is also possible for more than two, for example three or five, degassing stages to be connected in series. The degassing stages comprise spray degassers having an evacuatable container. For conditioning of the coating slip, a thermostating means in which the desired temperature of the coating slip can be established by heating or cooling is connected upstream of the first degassing stage.

LIST OF REFERENCE NUMERALS

1 Coating apparatus
2 Web-like substrate
3 Film
4 Application point
5 First deflection roll
6 Second roll
7 Conveying direction
8 Nozzle body
9 Outlet orifice
10 Surface of substrate
11 Roughness
12 Film thickness
13 Air doctor blade

We claim:

1. A process for the production of singly and/or multiply coated paper and/or board, which are particularly suitable for printing, packaging and inscription, comprising coating the substrate with a coating liquid of a free-falling liquid curtain, wherein the coating liquid has an extensional viscosity, measured by the CaBER method, of from 1 to 1000 Pa·s at a Hencky strain of from 6 to 15, the coating liquid has a solid content of from 40% to 75% by weight, the coating liquid has a Brookfield viscosity of from 0 to 5000 mPa·s, a coat weight of a coating slip is from 0.1 $g/m^2$ to 50 $g/m^2$ based on a dry weight on the substrate, and the coating liquid comprises polyacrylamides which have a molecular weight Mw of from 20 to 50 million.

2. The process according to claim 1, wherein the extensional viscosity, measured by the CaBER method, is from 5 to 500 Pa·s at a Hencky strain of from 6 to 12.

3. The process according to claim 1, wherein the extensional viscosity, measured by the CaBER method, is from 10 to 100 Pa·s at a Hencky strain of from 6 to 8.

4. The process according to claim 1, wherein the coating liquid has a Brookfield viscosity of from 20 to 2000 mPa·s.

5. The process according to claim 1, wherein the coating liquid has a Brookfield viscosity of from 20 to 1000 mPa·s.

6. The process according to claim 1, wherein the coating liquid has a solids content of from 50 to 75% by weight.

7. The process according to claim 1, wherein the coating liquid has a solids content of from 60 to 75% by weight.

8. The process according to claim 1, wherein the coating liquid comprises polyacrylamides which have a molecular weight Mw of from 20 to 45 million.

9. The process according to claim 1, wherein the coating liquid has a Brookfield viscosity of from 20 to 2000 mPa·s.

10. The process according to claim 1, wherein the coating liquid comprises one or more polymers based on ethylene/acrylic acid waxes, polyethylene, polyesters, styrene/butadiene latex binders, styrene/acrylate latex binders, styrene/butadiene/acrylonitrile latex binders, styrene/maleic anhydride binders, styrene/acrylate/maleic anhydride binders, polysaccharides, proteins, polyvinylpyrrolidones, polyvinyl alcohol, polyvinyl acetate, cellulose and cellulose derivatives and silicones.

11. The process according to claim 1, wherein the coating liquid comprises at least one binder.

12. The process according to claim 11, wherein the binder is selected from the group consisting of a styrene/butadiene latex binder, a styrene/acrylate latex binder, a styrene/butadiene/acrylonitrile latex binder, a styrene/maleic anhydride binder, a styrene/acrylate/maleic anhydride binder, a polysaccharide, a protein, a polyvinylpyrrolidone, a polyvinyl alcohol, a polyvinyl acetate, cellulose, a cellulose derivative, and combinations thereof.

13. The process according to claim 1, wherein the coating liquid comprises a pigment.

14. The process according to claim 13, wherein the pigment is selected from the group consisting of clay, kaolin, talc, calcium carbonate, titanium dioxide, satin white, a synthetic polymer pigment, a zinc oxide, a barium sulfate, gypsum, silica, an aluminum trihydrate, and combinations thereof.

* * * * *